United States Patent [19]

Funaki

[11] Patent Number: 4,803,821

[45] Date of Patent: Feb. 14, 1989

[54] TILED WALL STRUCTURE

[76] Inventor: Motokatsu Funaki, 430 Shimotsuchidana, Fujisawa-shi, Kanagawa-ken, Japan

[21] Appl. No.: 150,175

[22] Filed: Jan. 29, 1988

[30] Foreign Application Priority Data

Mar. 5, 1987 [JP] Japan ..... 62-48862

[51] Int. Cl.[4] ..... E04F 13/08

[52] U.S. Cl. ..... 52/387; 52/551

[58] Field of Search ..... 52/384–387, 52/551

[56] References Cited

U.S. PATENT DOCUMENTS

| | | | |
|---|---|---|---|
| 1,982,560 | 11/1934 | Williams | 52/387 |
| 2,043,706 | 6/1936 | Myers | 52/387 |
| 2,202,568 | 5/1940 | Worden | 52/387 |
| 3,533,206 | 10/1970 | Passeno | 52/387 |
| 4,011,702 | 3/1977 | Matyas | 52/387 |
| 4,193,230 | 3/1980 | Piana | 52/387 |

FOREIGN PATENT DOCUMENTS

| | | | |
|---|---|---|---|
| 190377 | 8/1986 | European Pat. Off. | 52/387 |

*Primary Examiner*—J. Karl Bell

*Attorney, Agent, or Firm*—Blum Kaplan

[57] ABSTRACT

A tiled wall structure capable of effectively preventing rainwater from entering the structure through a gap between tile blocks and permitting a mounting plate to exhibit rigidity sufficient to significantly increase strength of the wall structure. The tiled wall structure is so constructed that each of holding plates which are provided with holding pawls for holding the tile blocks thereon is fixedly and integrally mounted on the mounting plate in a manner to extend over each two mounting surface sections adjacent to each other through each of reinforcing grooves and the tile blocks each are securely held through recesses formed on the inner surface thereof on the holding pawls of the holding plate.

19 Claims, 11 Drawing Sheets

TILED WALL STRUCTURE

BACKGROUND OF THE INVENTION

1. Field of the Invention

This invention relates to a tiled wall structure, and more particularly to an improvement in a wall structure which comprises a combination of a mounting plate and tile blocks and is mounted on a wall base of a building for use as an external wall of a building.

2. Description of the Prior Art

A conventional tiled wall structure of such type is typically constructed in such a manner as shown in FIGS. 1 and 2.

More specifically, the conventional tiled wall structure includes a mounting plate 1 mounted through a backing member 2 on a wall base of a building (not shown) or the like and tile blocks 3 held on the mounting plate 1. The mounting plate 1 is provided on an outer surface thereof with a plurality of laterally extending holding pawls 4 of an L-shape which are formed by raising parts of the mounting plate 1 and arranged at predetermined intervals in a vertical direction thereof. Corresponding to the holding pawls 4 of the mounting plate 1, the tile blocks 3 each are formed on an inner surface thereof with recesses 5, in which the holding pawls 4 of the mounting plate 1 are received to hold the tile block on the mounting plate 1.

In the conventional tiled wall structure constructed as described above, a gap between the tile blocks 3 mounted on the mounting plate 1 is filled with a joint sealant for the purpose of preventing rainwater from entering the wall structure. However, the so-charged joint sealant deteriorates with time and often subjected to a high temperature to lead to failure or breakage, resulting in rainwater entering the wall structure through the broken joint sealant.

Further, the conventional tiled wall structure fails to cause the mounting plate to exhibit sufficient rigidity and strength because the mounting plate is formed into a flat shape and a plurality of the holding pawls are formed on the flat mounting plate by raising.

Accordingly, it would be highly desirable to develop a tiled wall structure which is capable of effectively preventing entrance of rainwater and causing a mounting plate to exhibit sufficient strength.

SUMMARY OF THE INVENTION

Generally speaking, in accordance with the present invention, a tiled wall structure is provided. The tiled wall structure includes a mounting plate including a plurality of mounting surface sections extending in parallel to each other and a reinforcing groove defined between each two mounting surface sections adjacent to each other. The structure also includes at least one holding plate mounted on the mounting plate and provided on an outer surface thereof with tile block holding means. On the outer surface of the holding plate is held at least one tile block, which is formed on at least an inner surface thereof with at least one recess in which the tile block holding means of the holding plate is securely fitted to cause the tile block to be held on the holding plate.

In a preferred embodiment of the present invention, the holding plate is mounted on the mounting plate to cover or extend over each two mounting surface sections adjacent to each other through the reinforcing groove.

Accordingly, it is an object of the present invention to provide a tiled wall structure which is capable of exhibiting satisfactory function and safety.

It is another object of the present invention to provide a tiled wall structure which is capable of effectively preventing rainwater from entering the wall structure.

It is a further object of the present invention to provide a tiled wall structure which is capable of causing a mounting plate to exhibit satisfactory rigidity and strength to ensure safety of the structure.

Still other objects and advantages of the present invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout; wherein:

FIGS. 8 and 9 show a third embodiment of a tiled wall structure according to the present invention, wherein FIG. 8 is a fragmentary perspective view showing a mounting plate employed in the third embodiment and FIG. 9 is a fragmentary plan view showing engagement or connection between a mounting plate and a holding plate in the third embodiment;

FIGS. 10 to 12 show a fourth embodiment of a tiled wall structure according to the present invention, wherein FIG. 10 is a fragmentary perspective view showing a mounting plate employed in the fourth embodiment, FIG. 11 is a fragmentary perspective view showing a holding plate employed in the fourth embodiment and FIG. 12 is a vertical sectional view showing an essential part of the fourth embodiment;

FIGS. 13 and 14 show a fifth embodiment of a tiled wall structure according to the present invention, wherein FIG. 13 is a fragmentary perspective view showing a holding plate incoporated in the fifth embodiment and FIG. 14 is a vertical sectional view showing an essential part of the fifth embodiment;

DETAILED DESCRIPTION OF THE PREFERRED EMBODIMENTS

Now, a tiled wall structure according to the present invention will be described hereinafter with reference to FIGS. 3 to 20.

Figure 3:
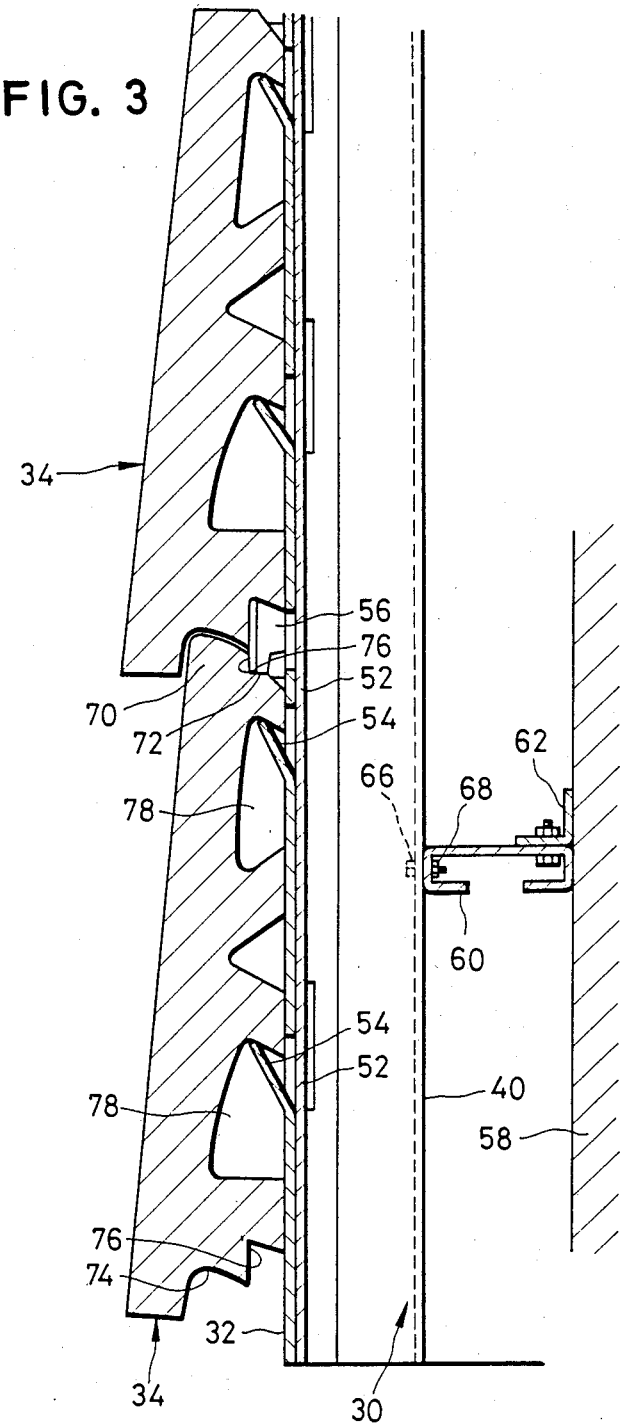
FIG. 3 is a fragmentary vertical sectional side elevation view showing an essential part of a first embodiment of a tiled wall structure according to the present invention.

FIGS. 3 to 6 shows a first embodiment of a tiled wall structure according to the present invention. A tiled wall structure of the first embodiment generally includes a mounting plate 30 which is adapted to be fixed on a wall base of a building as described hereinafter, at least one holding plate 32 and at least one tile block 34 mounted through the holding plate 32 on the mounting plate 30, as shown in FIG. 3. In the illustrated embodiment, a plurality of the holding plates 32 are arranged on the mounting plate 30.

Figure 4:
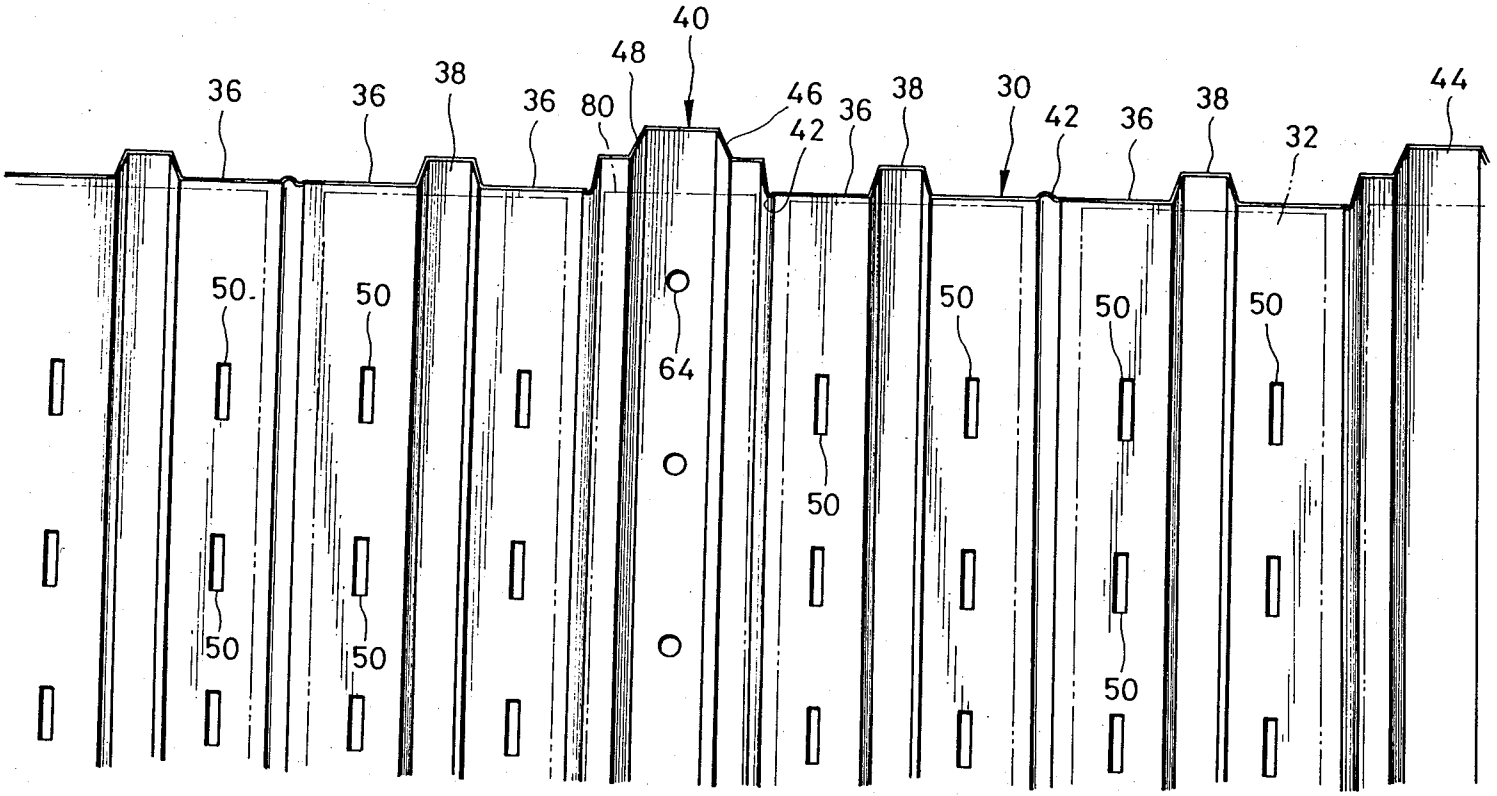
FIG. 4 is a fragmentary perspective view showing a mounting plate incorporated in the tiled wall structure shown in FIG. 3.

The mounting plate 30, as shown in FIGS. 3 and 4, includes a plurality of mounting surface sections 36 which, in the illustrated embodiment, are formed so as to be substantially flat and vertically extend in parallel to each other. Between the respective adjacent two mounting surface sections 36 are formed a plurality of reinforcing grooves 38. At least one of the reinforcing grooves 38 may be suitably replaced with at least one mounting groove 40 and/or at least one adjusting groove 42. Also, the mounting plate 30 includes connections 44 at both side ends. The so-constructed mounting plate 30 may be formed of a metal plate such as a steel sheet by pressing.

The reinforcing groove 38 is formed into a substantially trapezoid shape so as to have a somewhat enlarged open end. The mounting groove 38 is formed into a double-recess shape or so as to have a shallow recess portion 46 formed into such a shape as obtained by vertically cutting the reinforcing groove 38 into two halves and then separating them from each other and a deep recess portion 48 positioned at an intermediate of the shallow recess portion 46 and formed into a substantially trapezoid shape. The adjusting groove 42 is formed into a subtantially U-shape and acts to carry out adjustment a width of the mounting plate 30 in a lateral direction thereof or contraction and enlargement of a width of the plate 30. In the illustrated embodiment, the adjusting groove 42 is arranged between the mounting surface sections 36 interposed between the reinforcing grooves 38 adjacent to each other. Also, it is arranged between each of both side ends of the mounting groove 40 and the mounting surface section 36 adjacent thereto. Also, in the embodiment, the end connections 44 arranged at both sides of the mounting plate 30 each are formed into a shape like the mounting groove 40.

In the illustrated embodiment, the mounting plate 30 is so formed that one mounting groove 40 is arranged at a substantially central position of the mounting plate 30 and two reinforcing grooves 38 are arranged between the mounting groove 40 and each of the end connections 44.

The mounting surface sections 36 each are formed with at least one holding hole 50. In the embodiment, a plurality of the holding holes are formed at predetermined intervals in a vertical direction of the mounting surface section. The corresponding holding holes 50 of the mounting surface section 36 adjacent to each other through the reinforcing groove 38 interposed therebetween are aligned with each other and laterally spaced from each other at a predetermined interval.

Figure 5:
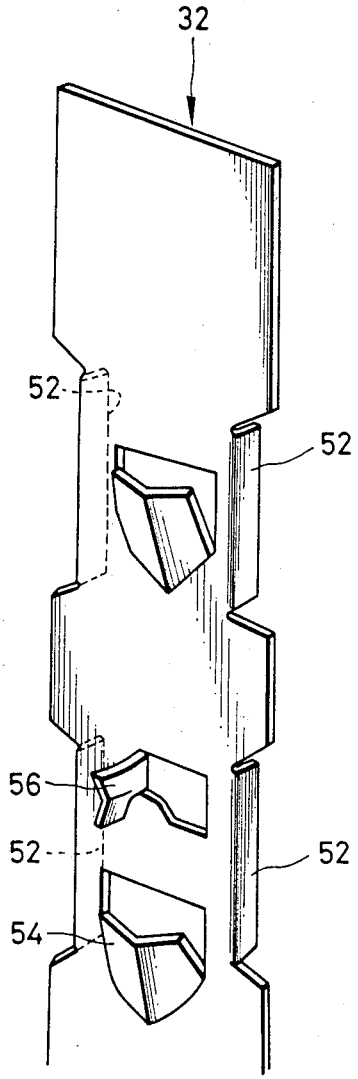
FIG. 5 is a fragmentary perspective view showing a holding plate incorporated in the tiled wall structure shown in FIG. 3.

The holding plate 32, as shown in FIGS. 3 and 5, includes at least one pair of engagement elements 52 corresponding to each pair of the laterally spaced holding holes 50 of the mounting plate 30. In the illustrated embodiment, the engagement elements 52 are arranged in pairs on both sides of the holding plate 32 in a intermittent manner in a longitudinal or vertical direction of the holding plate 32. Also, each pair of the engagement elements 52 on both sides of the holding plate 32 are arranged at an interval which corresponds to that between the holding holes 50 of the mounting surface sections 36 adjacent to each other through the reinforcing groove 38. In the illustrated embodiment, the engagement elements 52 each are formed by inwardly and substantially perpendicularly bending both sides of the holding plate 32. The holding plate 32 also includes tile block holding means 54 which serves to hold the tile blocks 34 therethrough on the holding plate. In the illustrated embodiment, the tile block holding means 54 comprises at least one or a plurality of holding pawls which are arranged on an outer surface of the holding plate 32 at predetermined intervals in the longitudinal direction of the plate 32. The holding pawls 54 each may be formed by obliquely upwardly raising a part of the holding plate 32 in a substantially V-shape to outwardly project from the holding plate 32. Further, the holding plate 32 includes firm connection means 56 for securely connecting vertically adjacent tile blocks to each other. In the illustrated embodiment, the connection means 56 comprises a plurality of press pawls 56 arranged between the respective adjacent two holding pawls 54. The the press pawls 56 each may be formed by raising a part of the holding plate 32 in such a manner as to open a door to outwardly perpendicularly project from the holding plate. Also, each of the press pawls 56 is formed into a substantially sideways V-shape.

The so-constructed holding plate 32, as shown in FIGS. 3 to 6, is fixed on an outer surface of the mounting plate 30 by caulking or by fittedly engaging each pair of the engagement elements or projections 52 in each pair of the holding holes 50 of the mounting surface sections 36 adjacent to each other through the reinforcing groove 38 and bending distal ends of the engagement elements 52 projecting from the holes 50. This results in the holding plates 32 being integrally mounted on the mounting plate 30 so as to extend over the respective adjacent two mounting surface sections 36 in a manner to be closely contacted with the surface sections.

In order that a combination comprising the mounting plate 30 and holding plates 32 coupled together as described above is mounted on a wall base 58 of a building, the wall base 58 has mounting members 60 each fixedly supported thereon by means of an angle-like connection 62 and also acting as a beam. More particularly, the combination is mounted on the wall base 58 by fixing the mounting plate 11 on the mounting members 60 through mounting holes 64 formed at the mounting groove 40 at predetermined intervals in the vertical direction of the mounting plate 30 by means of bolts 66 and nuts 68. Connection between the mounting plates 30 adjacent to each other is carried out by joining the end connections 44 to one another in order.

Each of the tile blocks 34, as shown in FIG. 3, is integrally formed at an upper end thereof with an engagement projection 70, which is formed on an inner surface thereof with an upper recess 72. The tile block 34 is also formed at a lower end thereof with an engagement recess 74 which is adapted to receive an engagement projection 70 of a lower adjacent tile block 34 therein. Further, the tile block is formed on an inner side of the engagement recess 70 with a lower recess 76 which is adapted to be aligned with the upper recess 72 of the lower adjacent tile block 34. The upper recess 72 and lower recess 76 of the vertically adjacent two tile blocks cooperate to define a space in which the firm connection means or press pawl 56 of the holding plate 32 is received. In addition, the tile block 34 is formed on at least an inenr surface thereof with at least one recess 78. In the embodiment, two such recesses 78 are arranged on the inner surface in a manner to be vertically spaced from each other, in which the holding pawls 54 of the holding plate 32 are engagedly fitted. The recesses 78 each may be formed into a shape which permits it to be securely engaged with the holding pawl 54 of the holding plate 32.

Figure 2:
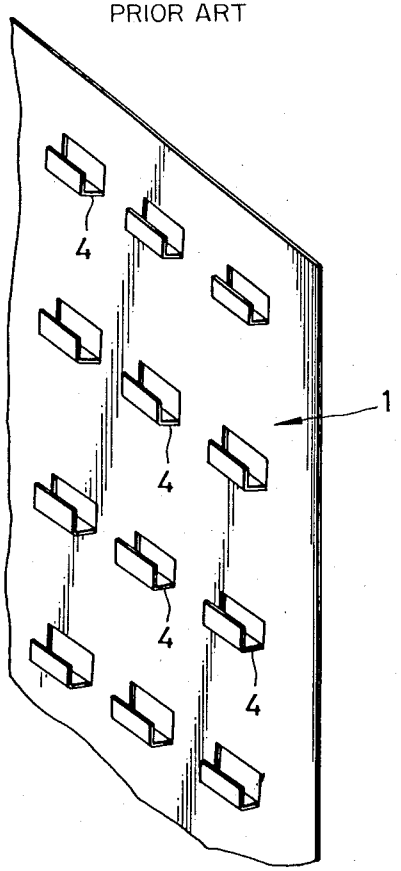
FIG. 2 PRIOR ART
FIG. 2 is a fragmentary perspective view showing a mounting plate employed in the conventional tiled wall structure shown in FIG. 1.
Figure 1:
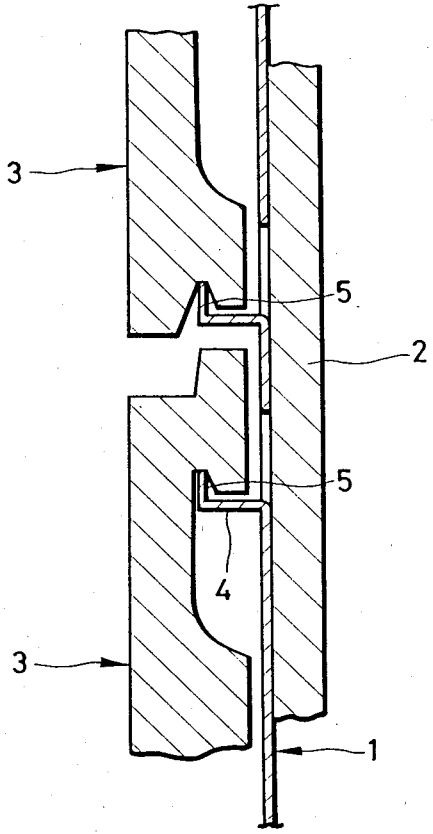
FIG. 1 PRIOR ART
FIG. 1 is a fragmentary vertical sectional side elevation view showing an essential part of a conventional tiled wall structure.

The so-constructed tile blocks 34 each are mounted on the holding plate 32 by engaging the holding pawl 54 of the holding plate with an upper wall of each of the recess 78 of the tile block 34 as shown in FIG. 1. Connection between two tile blocks vertically adjacent to each other is performed by the upper engagement projection 70 of the lower tile block 34 in the engagement recess 74 of the upper tile block 34 and fitting the press pawl 56 in the space formed due to cooperation between the upper and lower recesses 72 and 76 to press down the press pawl 56 by means of the upper tile block, resulting in secure engagement between both tile blocks 34 through the press pawl 56. Connection between the tile blocks laterally adjacent to each other may be satisfactory carried out using a conventional procedure widely known in the art.

In the first embodiment constructed as described above, the holding plates 32 each are fixedly arranged on the mounting plate 30 so as to cover or extend over each pair of the vertically extending mounting surface sections 36 adjacent to each other through each of the reinforcing grooves 38 and in the manner to be intimately contacted with the mounting plate 30. Such construction of the embodiment permits the the holding plate 32 to reinforce the mounting plate. This results in rigidity and strength of the mounting plate 30 in the vertical direction being highly improved in cooperation with the fact that the mounting plate 30 is formed with the vertically extending reinforcing and mounting grooves 38 and 40. In the first embodiment, a cover plate 80 may be fitted in the mounting groove 38 to cover it. This not only leads to a further increase in rigidity and strength of the mounting plate 30 but prevent rainwater from entering the wall structure through the mounting groove 38.

Also, in the first embodiment, the holding plates 32 each are fixedly and closely mounted on the mounting plate 30 through the fitted engagement between the holding holes 50 of the mounting surface sections 36 and the engagement elements 52 of the holding plate 32. Accordingly, the embodiment effectively prevents rainwater entering a gap between the tile blocks from further entering an inside of the mounting plate 30. In the embodiment, the rainwater is discharged through the reinforcing grooves 38.

Furthermore, arrangement of the vertically extending adjustment grooves 42 on the mounting plate 30 permits a lateral length or width of the mounting plate 30 to be suitable enlarged or contracted as desired to facilitate operation of arranging the tile blocks 34 on the holding plate 32.

Figure 7:
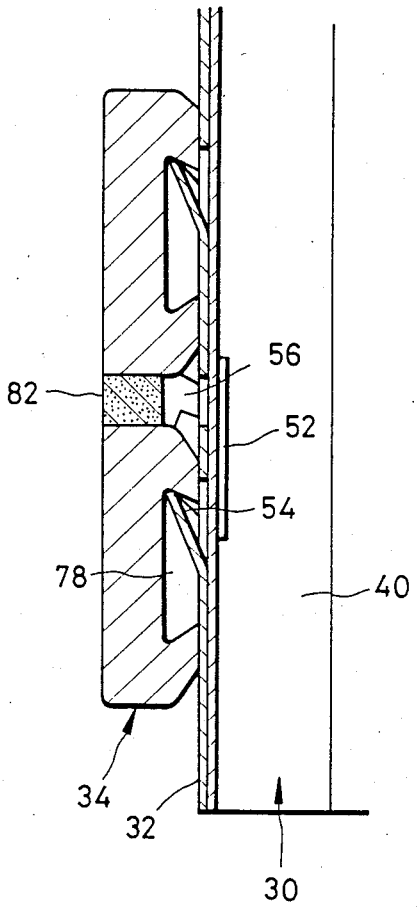
FIG. 7 is a fragmentary vertical sectional side elevation view showing an essential part of a second embodiment of a tiled wall structure according to the present invention.
Figure 6:
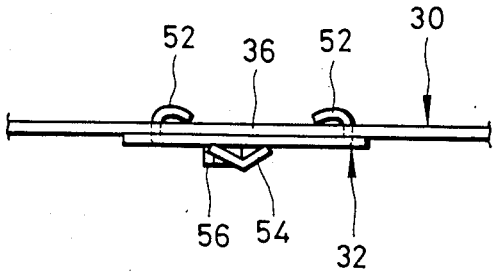
FIG. 6 is a fragmentary plan view showing engagement and connection between a mounting plate and a holding plate in the embodiment shown in FIG. 3.

FIG. 7 shows an essential part of a second embodiment of a tiled wall structure accroding to the present invention. In a tiled wall structure of the second embodiment, tile blocks 34 each are formed on an inner surface thereof with a single recess 78 and a press pawl 56 of a holding plate 32 is arranged above each of holding pawls 54. In a gap between the tile blocks 34 adjacent to each other in a vertical direction is filled a joint sealant 82 to more effectively prevent rainwater from entering therethrough into the wall structure and more firmly connect the tile blocks 34 together. The remaining of the second embodiment such as integral mounting of the holding plates 32 on a mounting plate 30, holding of the tile blocks 34 on each of the holding plates 32, and the like is constructed in substantially the same manner as in the first embodiment described above. Thus, it will be noted that the second embodiment more positively exhibits the function and advantages of the present invention.

Figure 9:
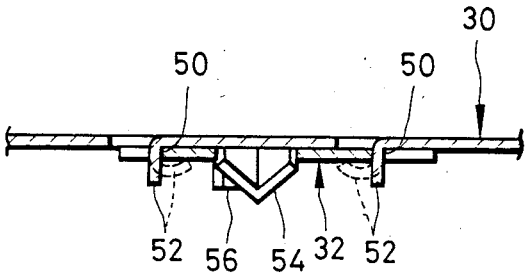
Figure 8:
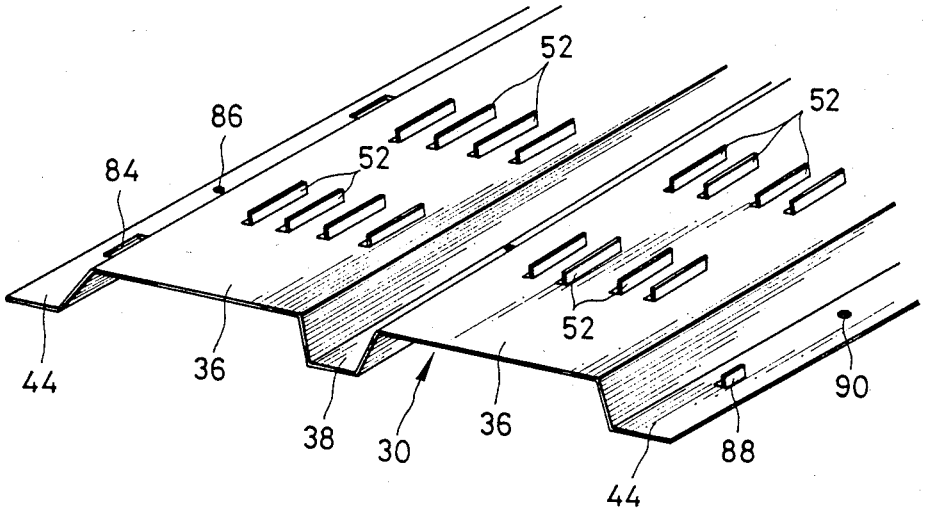

FIGS. 8 and 9 show a third embodiment of a tiled wall structure according to the present invention. In a tiled wall structure of the third embodiment, coupling between a mounting plate and each of holding plates is carried out in s manner different from the first embodiment described above. More particularly, mounting surface sections 36 each are provided thereon with a plurality of engagement elements or projections 52 instead of the holding holes 50 in the first embodiment described above. The projections 52 each may be formed by raising a part of the mounting surface section 36. Correspondingly, the holding plates 32 each are formed with a plurality of holding holes 50 instead of the engagement elements 52 in the first embodiment. However, it will be readily noted that the third embodiment exhibit substantially the same function and advantages as the first embodiment.

Further, the third embodiment is so constructed that only reinforcing grooves 38 are arranged between the respective adjacent two mounting surface sections 36 of the mounting plate 30, and one of end connections 44 of a flat shape is formed with holding holes 84 and mounting holes 86 and the other is formed with raised holding elements 88 and mounting holes 90 for the purpose of mounting of the mounting late on a wall body 58 of a building and connection between the mounting plates 30. The mounting holes 86 and 90 are formed so as to positionally correspond to one another. Connection between the mounting plates 30 is attained by inserting the holding elements 88 in the holding holes 84 and then caulking the elements 88. Mounting of the so-connected mounting plates 30 on the wall base 58 of the building is carried out through the mounting holes 86 and 90.

Figure 10:
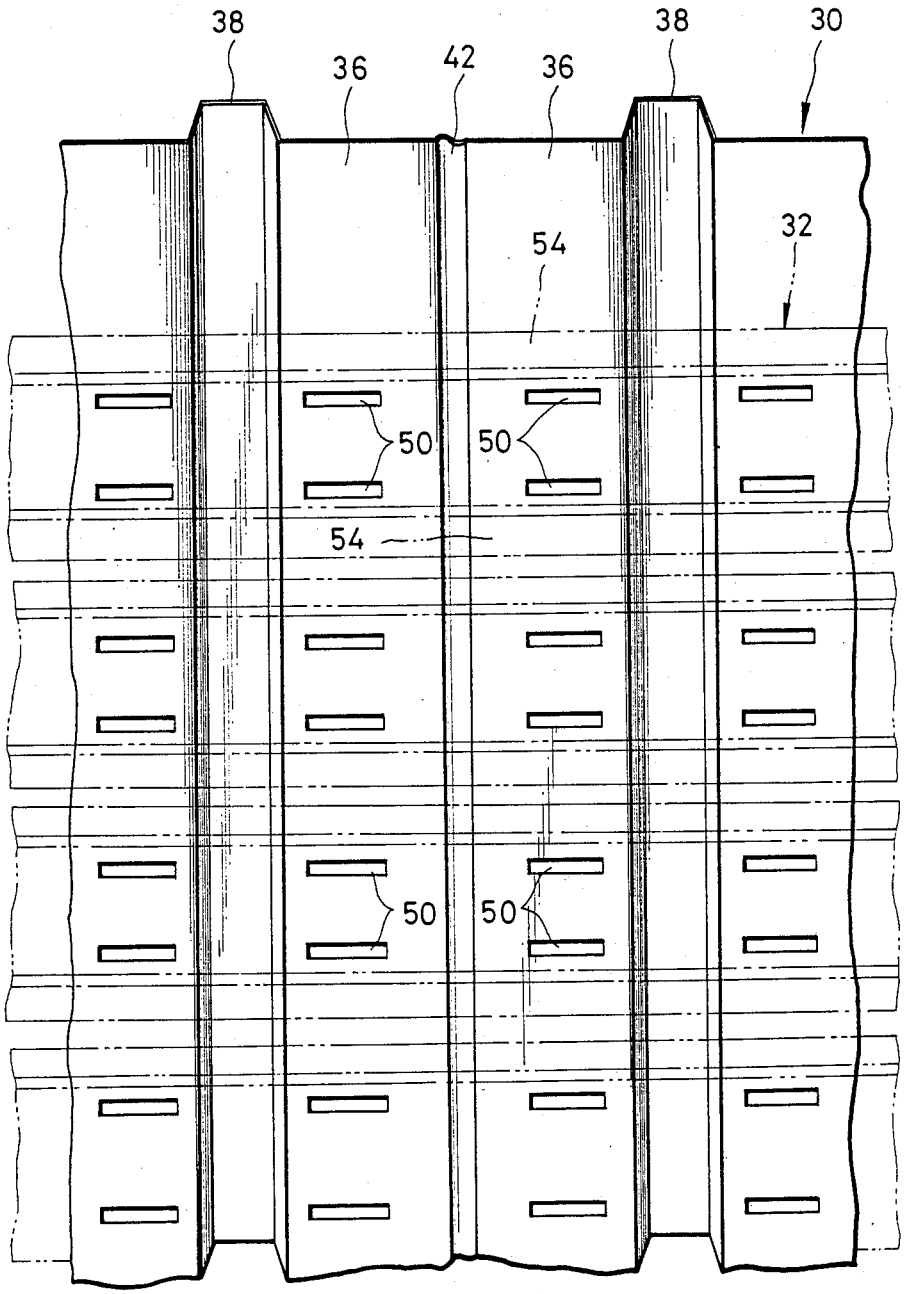
Figure 12:
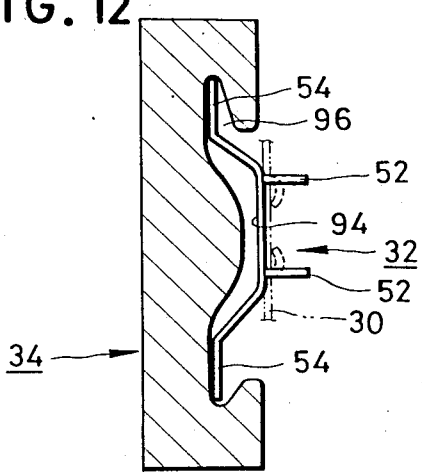
Figure 11:
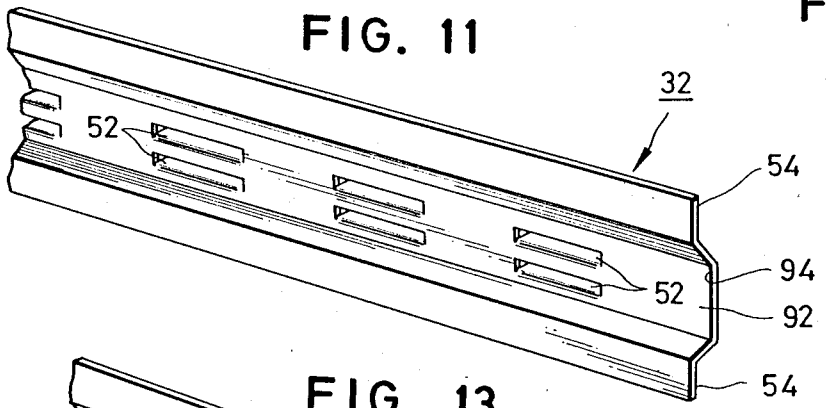

FIGS. 10 to 12 show a fourth embodiment of a tiled wall structure according to the present invention. A tiled wall structure of the fourth embodiment is so constructed that each of mounting surface sections 36 of a mounting plate 30 are formed with a plurality of pairs of vertically spaced holding holes 50 in a vertical direction thereof. The holding holes 50 of the mounting surface sections adjacent to each other are arranged in a manner to positionally correspond to one another in a lateral direction of the mounting plate 30. Each pair of the vertically spaced holding holes 50 in each of the mounting surface sections 36 of the mounting plate 30 are arranged at a predetermined interval as described below.

Each of holding plates 32 to be mounted on the mounting plate 30, as shown in FIG. 11, is formed so as to laterally extend and formed into a substantially trapezoid shape so as to provide a recess 92 extending in a longitudinal direction thereof and having a bottom wall 94, and tile block holding means 54 comprising an upper and lower flanges. The recess 92 is formed on a bottom wall thereof with a plurality of pairs of vertically spaced engagement elements 52 which are formed by rearwardly raising parts of the bottom wall 94 and arranged in the longitudinal direction of the mounting plate. A vertical interval between each pair of the vertically spaced holding holes 50 is determined so as to correspond to that between each pair of the vertically spaced engagement elements 52, and a lateral interval between the holding holes 50 of the laterally adjacent mounting surface sections 36 is determined to be substantially equal to that between the engagement elements 52 of each holding plate 32 laterally adjacent to each other. Mounting of each of the holding plates 32 on the mounting plate 30 is carried out by perpendicularly positioning the holding plate 32 with respect to the mounting surface sections 36 as shown in FIG. 10 to securely fit the engagement elements 52 in the holding holes 50 and then caulking the elements 52 or bending distal ends of the elements 52 projecting from the holding holes 50 as indicated at phantom lines in FIG. 12.

Also, in the fourth embodiment, each of tile blocks 34, as shown in FIG. 12, is formed on an inner surface with a space 96 of a shape sufficient to permit the upper and lower flanges or holding means 54 of the holding plate 32 to be securely fitted therein.

The remaining of the fourth embodiment may be constructed in substantially the same manner as the first embodiment. For example, the mounting plate 30 may be formed with a mounting groove and connection ends like those in the first embodiment other than the reinforcing grooves 38 and adjustment grooves 42 shown in FIG. 10.

The fourth embodiment constructed as described above permits rigidity of both the mounting plate 30 and holding plates 36 to be highly increased because a plurality of holding plates 32 are fixedly mounted on mounting plate 30 in the direction perpendicular to the vertically extending mounting surface sections 36.

Figure 14:
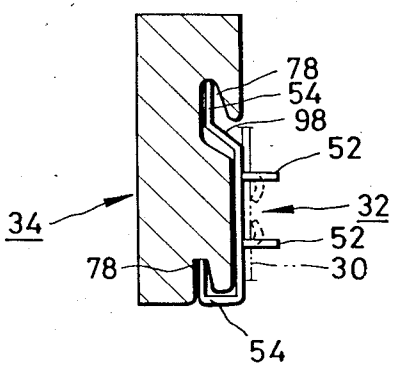
Figure 13:
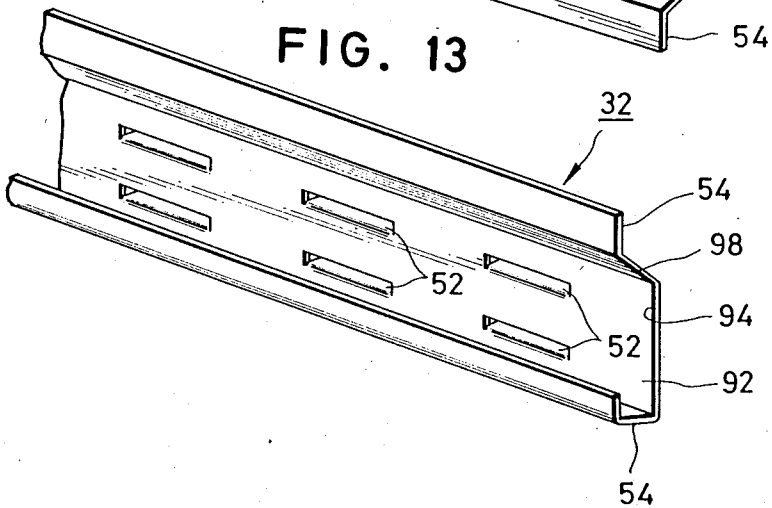

FIGS. 13 and 14 show a fifth embodiment of a tiled wall structure according to the present invention, wherein holding plates 32 each are constructed in a manner somewhat different from that in the fourth embodiment. More particularly, in the fifth embodiment, each of holding plates 32, as shown in FIG. 13, is formed so as to include an upper flange portion constituting a part of tile block holding means 54, an oblique portion 98 inwardly downwardly extending from the upper flange portion 54, a vertical portion 94 downwardly extending from the oblique portion 98 and a lower L-shaped portion 54 outwardly extending from a lower end of the vertical portion 94 and constituting another part of the tile block holding means 54. The vertical portion or bottom wall 94 of the holding plate 32 is formed with a plurality of vertically spaced engagement elements 52 in substantially the same manner as in the fourth embodiment described above. Mounting of the so-constructed holding plates 32 on a mounting plate 30 is carried out in substantially the same manner as in the fourth embodiment.

Also, in the fifth embodiment, each of tile blocks 34 is formed on inner and lower surfaces thereof with recesses 78 which are adapted to securely receive the upper flange portion 54 and lower L-shaped portion 54 therein to cause the tile block to be securely held on the holding plate 32, respectively.

Thus, it will be noted that the fifth embodiment exhibits substantially the same function and advantages as the fourth embodiment and the tile block is more firmly supported on the holding plate.

Figure 15:
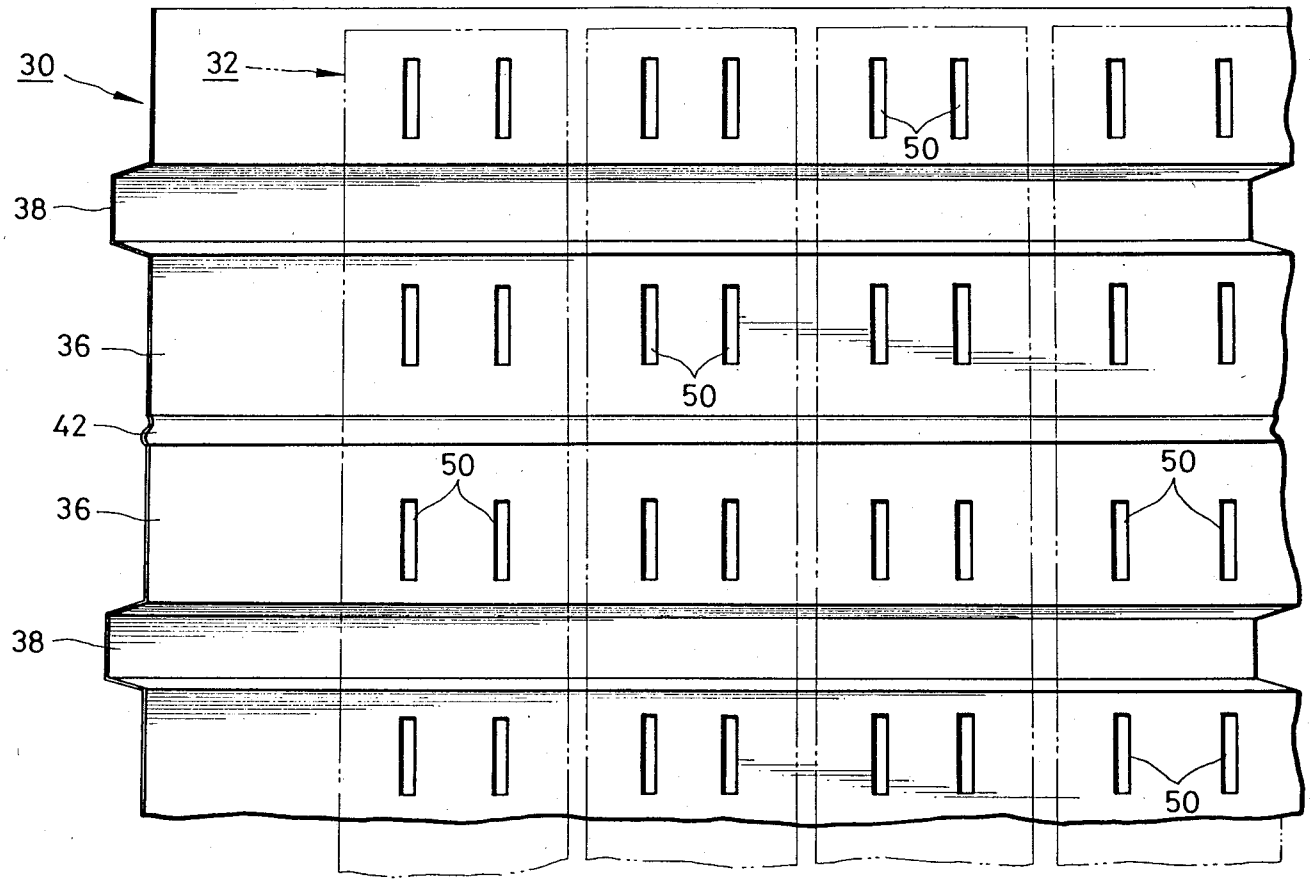
FIG. 15 is a fragmentary perspective view showing a mounting plate employed in a sixth embodiment of a tiled wall structure according to the present invention.

FIG. 15 shows a sixth embodiment of a tiled wall structure according to the present invention. A tiled wall structure of the sixth embodiment includes a mounting plate 30 constructed in substantially the same manner as that of the fourth embodiment shown in FIG. 10 but arranged in a manner shifted by an angle of 90 degrees and holding plates 32 constructed in substantially the same manner as those of the fourth embodiment shown in FIG. 11 or the fifth embodiment of FIG. 12 but arranged in a manner shifted by an angle of 90 degrees. The remaining of the sixth embodiment may be constructed in a manner similar to the fourth and/or fifth embodiments.

Figure 16:
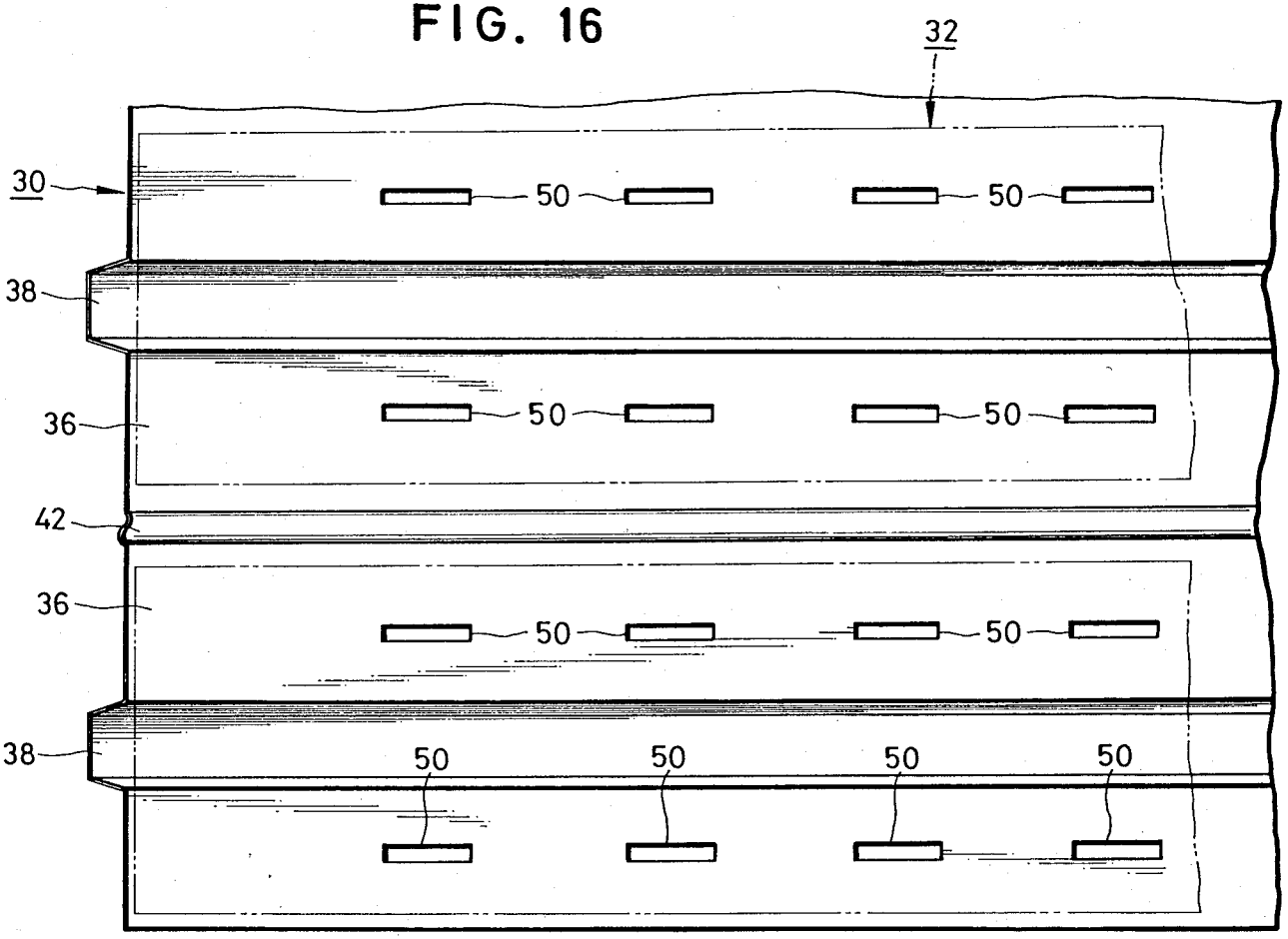
FIG. 16 is a fragmentary perspective view showing a holding plate employed in a seventh embodiment of a tiled wall structure according to the present invention.

FIG. 16 shows a seventh embodiment of the present invention, which includes a mounting plate 30 constructed in substantially the same manner as that of the first embodiment shown in FIG. 4 but arranged in a manner shifted by an angle of 90 degrees and holding plates 32 constructed in substantially the same manner as those of the fourth embodiment shown in FIG. 11 or the fifth embodiment of FIG. 12 but arranged in a manner shifted by an angle of 90 degrees. The remaining of the sixth embodiment may be constructed in a manner similar to a combination of the first embodiment with the fourth or fifth embodiment.

It is a matter of course that the sixth and seventh embodiments constructed as described above each exhibit the same function and advantages as each of the embodiments described above.

Figure 18:
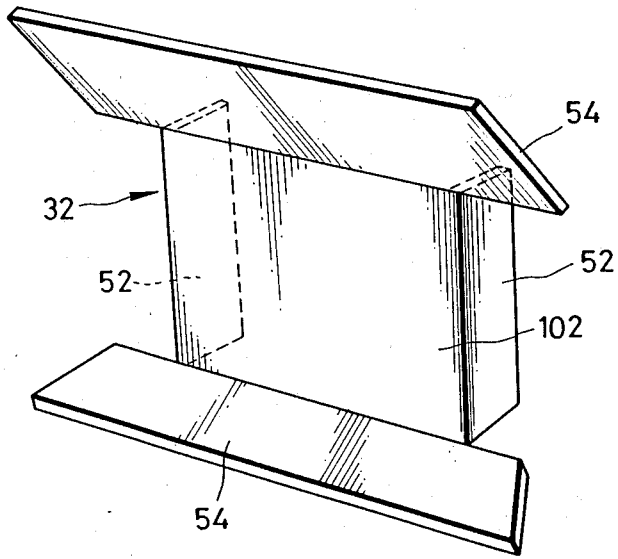
FIG. 18 is a fragmentary perspective view showing a holding plate in a ninth embodiment of a tiled wall structure according to the present invention.
Figure 17:
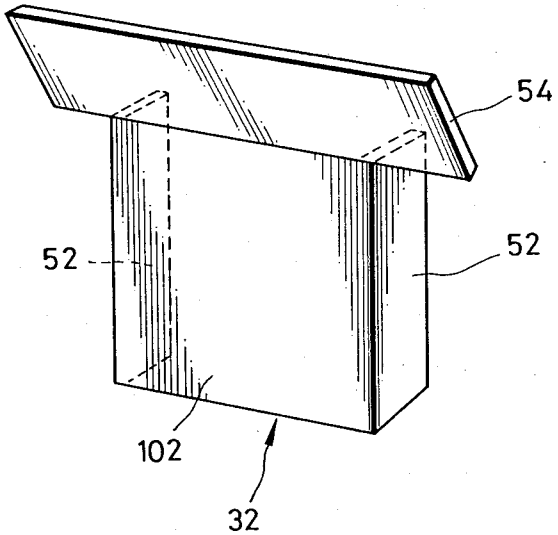
FIG. 17 is a fragmentary perspective view showing a holding plate in an eighth embodiment of a tiled wall structure according to the present invention.

FIGS. 17 and 18 show eighth and ninth embodiments of the present invention, respectively, in each of which holding plates 32 each are constructed in a manner different from the above-described embodiments. More particularly, in a tiled wall structure of the eighth embodiment, each of holding plates 32, as shown in FIG. 17, includes a plate body 102 formed into a small size sufficient to form engagement elements 52 on both sides thereof so as to extend along a whole length thereof. Also, the holding plate 32 includes tile block holding means 54 comprising an oblique plate member provided on an upper end of the plate body 102 so as to obliquely upwardly extend therefrom. The holding plate 32 of the eighth embodiment may be integrally formed by cutting and bending a single metal sheet.

In the ninth embodiment of FIG. 18, each of holding plates 32 is constructed to include a plate body 102 formed like that of the eighth embodiment, engagement elements 52 provided on both sides of the plate body 102 so as to extend along a whole length thereof, and tile block holding means 54 comprising plate members mounted on upper and lower ends of the plate body 102 so as to outwardly extend obliquely upwardly and obliquely downwardly so as to be gradually spaced from each other, respectively.

In each of the eighth and ninth embodiments, a plurality of the so-constructed holding plates 32 are arranged and fixedly mounted through the engagement elements 52 on a mounting plate in a plurality of rows and hold tile blocks by means of the holding pawls 54. Thus, it will be noted that the embodiments exhibit the same function and advantages as those discribed above.

In each of the first to ninth embodiments, connection between the mounting plate 30 and the holding plates 32 is accomplished by fitting the engagement elements 52 in the holding holes 50 and then caulking the ends of the engagement elements 52 projected from the holding holes 50. However, it may be carried out by fixing the plate body of each of the holding plates 32 on the mounting surface section 36 of the mounting plate 30 by any other suitable means such as welding, spot welding or the like. Welding such as spot welding is suitable for preventing rainwater from entering the wall structure through the connection between the holding plates and the mounting plate.

Figure 19:
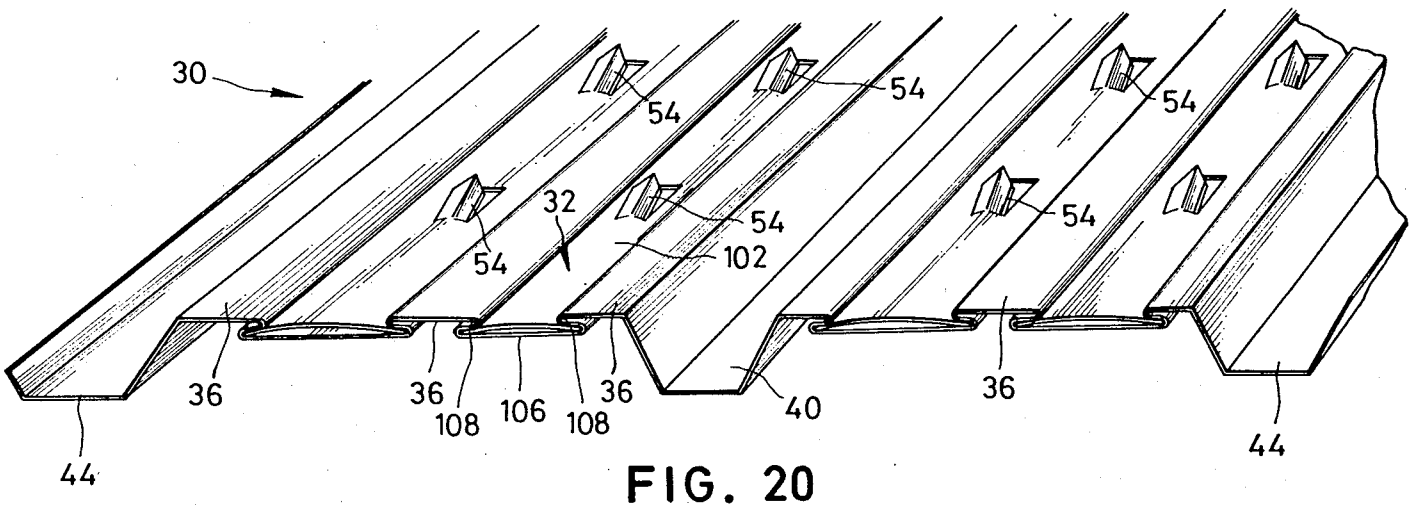
FIG. 19 is a fragmentary perspective view showing engagement between a mounting plate and a holding plate in a tenth embodiment of a tiled wall structure according to the present invention.
Figure 20:
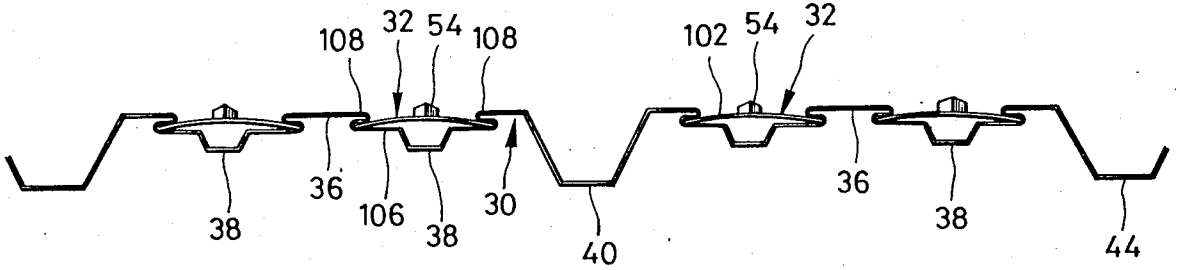
FIG. 20 is a schematic plan view showing engagement between a mounting plate and a holding plate in an eleventh embodiment of a tiled wall structure according to the present invention.

FIGS. 19 and 20 show tenth and eleventh embodiments of the present invention, respectively. In each of both embodiments, a mounting plate 30 is constructed to include a single mounting groove 40 formed into a trapezoid shape and arranged at an intermediate of the plate 30, both end connections 44, and a plurality of mounting surface sections 36 interposed between each of the end connections 44 and the mounting groove 40. The mounting plate 30 also includes a shallow recess 106 between each adjacent two mounting surface sections 36, which is formed at both sides thereof with longitudinally extending folds 108. In each of the recesses 106 is inserted a holding plate 32 through the folds 108. The holding plate 32 is formed thereon with tile block holding means 54 comprising a plurality of holding pawls which are formed by raising parts of the holding plates 32 and arranged at predetermined intervals in a longitudinal direction of the holding plate. In the tenth embodiment, the shallow recess 106 also acts as a reinforcing groove like the groove 38 in the first embodiment, whereas, in the eleventh embodiment, the shallow recess 106 is formed at a bottm wall thereof with a reinforcing groove 38.

The tenth and eleventh embodiments constructed as described above each not only exhibit the same function and advantages as the aforementioned embodiments but effectively prevent rainwater from entering the wall structure because the connection between the mounting plate and holding plates is free of any holding holes. Also, when the connection is subjected to spot welding, the wall structure of the embodiment exhibits more rigidity.

As can be seen from the foregoing, the tiled wall structure of the present invention is so constructed that each of the holding plates which are provided with the tile block holding means for holding the tile blocks thereon is fixedly and integrally mounted on the mounting plate in a manner to cover or extend over each two mounting surface sections adjacent to each other through each of the reinforcing grooves and the tile blocks each are securely held through the recesses formed on the inner surface thereof on the tile block holding means of the holding plate. Such construction effectively prevents rainwater from entering the tiled wall construction through a gap between the tile blocks. Also, it permits the mounting plate to exhibit rigidity sufficient to significantly increase strength of the wall construction because the holding plates are integrally mounted on the mounting plate to reinforce it. Such an increase in rigidity and strength of the mounting plate allows it to be light-weighted. Furthermore, the present invention improves workability because connection between the mounting plate and the holding plates is facilitated by caulking, welding or the like.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all the generic and specific features of the invention herein described and all statements of the scope of the invention which, as a matter of language, might be said to fall therebetween.

What is claimed is:

1. A tiled wall structure comprising:

a mounting plate including a plurality of mounting surface sections extending in parallel to each other and a reinforcing groove defined between each two said mounting surface sections adjacent to each other;

at least one holding plate fixedly mounted on said mounting plate and provided on an outer surface thereof with tile block holding means; and at least one tile block held on said outer surface of said holding plate, said tile blocks being formed on at least an inner surface thereof with at least one recess in which said tile block holding means of said holding plate is securely fitted to cause said tile block to be held on said holding plate therethrough.

2. A tiled wall structure as defined in claim 1, wherein said holding plate is mounted on said mounting plate so as to cover each two said mounting surface sections adjacent to each other through said reinforcing groove.

3. A tiled wall structure as defined in claim 1, wherein said mounting surface sections are arranged so as to extend in a vertical direction of said mounting plate.

4. A tiled wall structure as defined in claim 1, wherein said mounting, surface sections are arranged so as to extend in a lateral direction of said mounting plate.

5. A tiled wall structure as defined in claim 1, wherein said tile block holding means comprises at least one holding pawl.

6. A tiled wall structure as defined in claim 5, wherein said holding pawl is formed by raising a part of said holding plate.

7. A tiled wall structure as defined in claim 1, wherein said recess is also formed on a lower surface of said tile block.

8. A tiled wall structure as defined in claim 1, wherein one of said each adjacent two mounting surface sections of said mounting plate and said holding plate is provided with at least one pair of holding holes and the other is provided with engagement elements corresponding to said holding holes, mounting of said holding plate on said mounting plate being carried out through firm engagement between said holding holes and said engagement elements.

9. A tiled wall structure as defined in claim 8, wherein said holding holes in a pair are laterally spaced from each other.

10. A tiled wall structure as defined in claim 8, wherein said holding holes in a pair are vertically spaced from each other.

11. A tiled wall structure as defined in claim 9, wherein said laterally spaced holding holes are arranged in a plurality of pairs in a vertical direction of said tiled wall structure.

12. A tiled wall structure as defined in claim 10, wherein said vertically spaced holding holes are arranged in a plurality of pairs in a lateral direction of said tiled wall structure.

13. A tiled wall structure as defined in claim 1, wherein at least one of a plurality of said reinforcing grooves is replaced with a mounting groove.

14. A tiled wall structure as defined in claim 1, wherein said reinforcing groove is formed on both sides thereof with folds extending in a longitudinal direction thereof;

said holding plate being received in said reinforcing groove through said folds;

said tile block holding means being arranged at predetermined intervals in a longitudinal direction of said hodling plate.

15. A tiled wall structure as defined in claim 2, wherein said holding plate is fixed on said mounting plate by welding.

16. A tiled wall structure as defined in claim 2, wherein said holding means is provided at upper and lower end portions of said holding plate.

17. A tiled wall structure as defined in claim 2, wherein said holding means is provided at an upper end of said holding plate.

18. A tiled wall structure as defined in claim 1, wherein at least one of a plurality of said reinforcing grooves is replaced with an adjustment groove.

19. A tiled wall structure as defined in claim 1, wherein said holding plate is provided with connection means for firmly connecting together said tile blocks vertically adjacent to each other.

* * * * *